United States Patent [19]

Lorber

[11] Patent Number: 4,802,263

[45] Date of Patent: Feb. 7, 1989

[54] DEVICE FOR CLIPPING PAPER

[76] Inventor: Kurt Lorber, Schurwaldstrasse 114, D-7307 Aichwald 2, Fed. Rep. of Germany

[21] Appl. No.: 69,424

[22] Filed: Jul. 2, 1987

[30] Foreign Application Priority Data

Jul. 15, 1986 [DE] Fed. Rep. of Germany ..... 3623766

[51] Int. Cl.[4] ..... B42F 1/02

[52] U.S. Cl. ..... 24/67.5; 24/535; 24/568

[58] Field of Search ..... 24/67.5, 67 R, 67.3, 24/67.7, 499, 513, 535, 557, 558, 568, DIG. 8

[56] References Cited

U.S. PATENT DOCUMENTS

| | | | |
|---|---|---|---|
| 622,610 | 4/1899 | Dudley | 24/557 |
| 1,965,554 | 7/1934 | Mainwaring | 24/558 |
| 2,740,897 | 4/1956 | Fairbank | 24/67.7 X |
| 3,402,442 | 9/1968 | Kruger et al. | 24/557 |
| 4,532,680 | 8/1985 | Hashimoto | 24/67.5 X |

FOREIGN PATENT DOCUMENTS

| | | | |
|---|---|---|---|
| 802340 | 7/1949 | Fed. Rep. of Germany | 24/67.5 |
| 3015901 | 11/1980 | Fed. Rep. of Germany . | |
| 830792 | 8/1938 | France | 24/558 |
| 13383 | of 1913 | United Kingdom | 24/67.5 |
| 609201 | 9/1948 | United Kingdom | 24/67.5 |
| 744958 | 2/1956 | United Kingdom | 24/67.3 |
| 1058094 | 2/1967 | United Kingdom | 24/67.5 |

*Primary Examiner*—Kenneth J. Dorner
*Assistant Examiner*—Laurie K. Cranmer
*Attorney, Agent, or Firm*—Steele, Gould & Fried

[57] ABSTRACT

A device for the detachable clipping of paper sheets contains an approximately U-shaped clip (11), whose leg ends form longitudinal edges (14), onto which are shaped pins (17). The leg ends of two levers (22) can be snapped into the pins (17) and engages on the lateral faces (18) of clip (11), so as to permit a forcing apart of clip (11).

11 Claims, 2 Drawing Sheets

DEVICE FOR CLIPPING PAPER

BACKGROUND OF THE INVENTION

1. Field of the Invention

The invention relates to a device for the detachable attaching and clipping of paper sheets and the like with a clip constructed as a cross-sectionally, roughly U-shaped profile, the leg ends of the profile forming two longitudinal edges of the clip, which can be elastically actuated until they reciprocally engage, as well as with two levers for forcing apart the clip articulated in the vicinity of the longitudinal edge of the clip and engageable with the sides of the latter.

2. Prior Art

Such clips are known as binder clips or foldbacks and are conventionally used in the USA and Japan. The clip comprises a bent metal sheet, whose longitudinal edges are turned back outwards and form circular bushes, into which the ends of the lever bent from wire can be inserted from the center through slits. In order to remove the levers, the ends thereof must be powerfully forced in the longitudinal direction of the longitudinal edges. This is extremely complicated, because the levers only have a stable position engaging on the sides of the profile or on the top of the paper stack. Thus, in most cases the levers are not removed.

SUMMARY OF THE INVENTION

An object of the present invention is to provide a device for the detachable clipping of paper sheets and the like, which is easy to manufacture and can be equally easily used.

According to the invention this object is achieved in that the clips and levers are injection moulded from plastic and the levers are articulated to the front ends of the clip. Through the articulation of the levers on the front ends of the clip, it is ensured that the levers can be more easily manipulated for fitting and removal purposes. For geometrical reasons the forces occurring when spreading apart the clip are better distributed, so that despite the clip being manufactured from plastic, it has a high service life. Unlike metal clips, the clip is not prejudicial in the computer field, has no sharp edges and is non-magnetic.

According to a further development, pins are shaped in one piece on the front ends of the longitudinal edges of the clip and onto said pins can be snapped the levers, provided with lateral slits. Thus, for lever fitting purposes, there is no longer any need for a force exerted in the longitudinal direction of the longitudinal edges and instead the levers can be snapped on in push button-like manner laterally, i.e. at right angles to the paper plane. This facilitates both the fitting and the removal of the clips and consequently the handling of the device proposed by the invention.

According to the invention the levers are constructed in bow or U-shaped manner with two legs running approximately parallel to the front edges of the clip and a cross-member and the legs are interconnected by a plate. Thus, the levers with the plate connecting the legs engaged on the clip side walls, so that there is a larger contact surface and consequently lower surface pressures. There is no need for the plate to engage on the entire lateral surface of the clip and this need only take place in the vicinity of the ends of the sides remote from the longitudinal edges, because the forces which occur are at the lowest level at this point.

This construction has the additional advantage that the leg ends have a somewhat greater elasticity, so that snapping on can be performed more easily.

According to the invention, the internal spacing of the lever legs is the same as the profile length of the clip. In this case the inner edges of the legs can, on forcing apart, engage on the front edges of the clip, so that reciprocal guidance is obtained.

According to the invention, the plate connecting the lever legs can have a smaller thickness than the legs, the plate being advantageously arranged in such a way that it is flush with the outer side of the leg in the spread-apart position, so that during spreading apart the sides of the clip are guided on all sides.

For better attachment to the sheets of paper to be joined, projections can be shaped onto the sides of the longitudinal edge of the clip directed towards one another. They are preferably shaped on both sides of the slit formed by the longitudinal edges and either alternate with one another or the extent of the projection alternates. This leads to a type of zig-zag line, which leads to a particularly favorable holding of the clip.

For the better mounting of the spread-apart clip on the paper stack, the longitudinal edges of the clip can have a thickened cross-section, which is in particular circular cylindrical. This also facilitates the fitting of the turning or swivel pins on the terminal edges.

BRIEF DESCRIPTION OF THE DRAWINGS

Further features, details and advantages of the invention can be gathered from the following description of a preferred embodiment of the invention with reference to the attached drawings, wherein show:

FIG. 1 is a plan view of the front end of a clip 11, which is intended for detachably clipping a layer of paper sheets. Clip 11 is constructed as an approximately U-shaped profile, which contains two legs 12, which are interconnected by a slightly bent cross-member 13. Each of the free ends of legs 12 form a longitudinal edge 14 of clip 11. The longitudinal extension of clip 11 is at right angles to the paper plane of FIG. 1. Both the longitudinal edges 14 are thickened and have an approximately circular cross-section. The sides 15 of the two longitudinal edges 14 of clip 11 directed towards one another are provided with gripping projections 16, only the first projection 16 being visible in FIG. 1.

Figure 2:
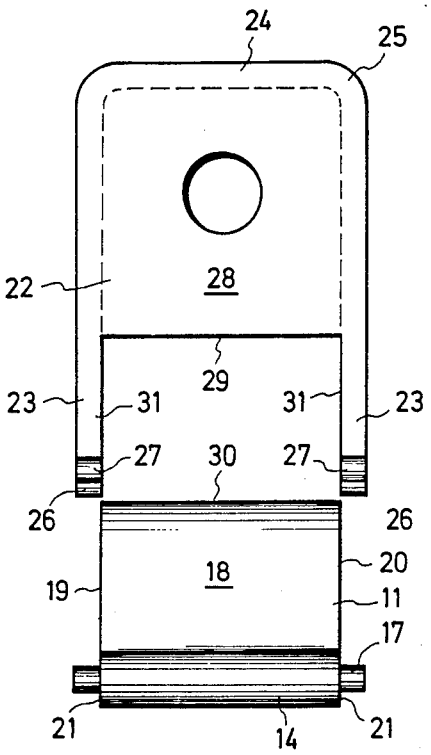
FIG. 2 is a side view of the clip with the lever removed.

On the represented front end of clip 11, a pin 17 is shaped in one piece in coaxial extension of the thickened longitudinal edges 14. The pins are used for articulating levers, with the aid of which the clips 11 can be spread or forced apart from the position shown in FIG. 1 in such a way that slit can form between the longitudinal edges 14 of clip 11 through which the paper edge can be inserted into the interior of clip 11. As a result of the elastic construction of clip 11 the longitudinal edges 14 are actuated in the represented position in which they engage on one another by their sides 15 directed towards one another.

Figure 1:
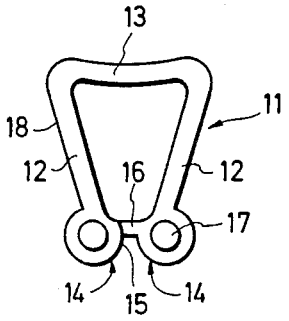
FIG. 1 is a plan view of the end face of a clip in the closed started.

FIG. 2 shows clip 11 from the side, i.e. from the right or left in FIG. 1, one of the lever being shown above clip 11. The lateral faces 18 of clip 11 extend in the longitudinal direction from one front end 19 to the other front end 20. The two front ends 19, 20 are parallel to one another in the side view of FIG. 2. The front ends 21 of the longitudinal edges 14 are flush with the front ends 19, 20 of clip 11. Pins 17 extend over the front ends 21 of longitudinal edges 14 in both directions. The two identically constructed levers 22 cooperating with clip 11 are roughly shaped like a U-shaped member with two legs 23, which are interconnected by a cross-member 24, the connecting points 25 being rounded. Each of the ends 26 of legs 23 remote from cross-member 24 has a slit 27, which is open towards the lateral face, shown in FIG. 2. With the aid of slits 27, whose internal diameter roughly corresponds to the external diameter of pin 17, being somewhat smaller than the latter, legs 23 of levers 22 can be snapped from the side onto pins 17, i.e. from the top in FIG. 2.

Legs 23 and cross-member 24 of lever 22 are interconnected by a plate 28, which is constructed in one piece with legs 23 and cross-member 24. The longitudinal edge 29 of plate 28 is spaced from the central axis of slits 27 by a distance which is smaller than the distance between the central axis of pin 17 and the outside 30 of cross-member 13 of clip 11. As a result plate 28 engages on lateral faces 18 of clip 11 if the levers with slits 27 are snapped onto pins 17 and the levers are used for forcing apart clip 11. The forces which occur are distributed over the entire length of the lateral faces 18 of clip 11.

The inside 31 of each leg 23 of lever 22 is parallel to the associated front end 19 or 20 of clip 11. Simultaneously the reciprocal spacing of the insides 31 of legs 23 is the same as the longitudinal spacing of the two front ends 19, 20 of clip 11.

Figure 3:
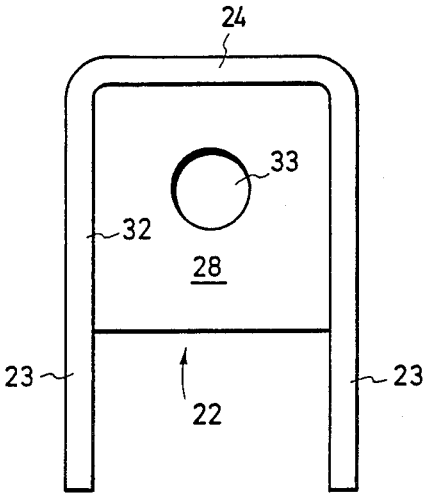
FIG. 3 is a view of the lever from the opposite side.

FIG. 3 shows lever 22 from the other side. As plate 28 has a smaller thickness than legs 23 and cross-member 24 and plate 28 is flush with the upper surface of legs 23 and cross-member 24 in FIG. 2, an all-round rim 32 is formed on the top side in FIG. 3. If levers 22 are brought into the spread-apart position of the clip, then said lateral faces 18 of clip 11 are located within rim 32, so that front ends 19, 20 are guided by the inside 31 of leg 23 and face 18 by the inside of plate 28. This leads to a good force transfer to the optimum large surface.

Figure 4:
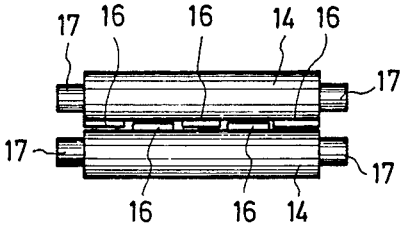
FIG. 4 is a plan view of the longitudinal edges of the clip, viewed from below in FIG. 1.

FIG. 4 shows a view of clip 11 from the bottom in FIG. 1. The four pins 17 are coaxial to the cylindrically widened longitudinal edges 14 of the clip. Projections 16 are provided on the sides of the longitudinal edges directed towards one another, while in the represented embodiment there are three projections 16 on the upper longitudinal edge and two projections 16 on the lower edge. The individual projections are alternately arranged on the two longitudinal edges 14 and from between them a roughly undulatory opening. The projections 16 have a reciprocal spacing in the longitudinal direction of clip 11.

Figure 5:
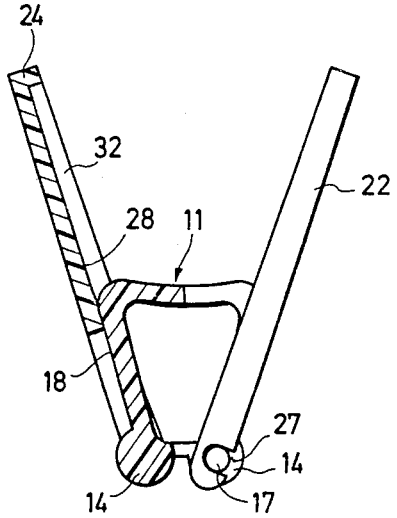
FIG. 5 is a part sectional plan view of the clip provided with levers from the same direction as in FIG. 1.

FIG. 5 shows a section through the clip provided with the levers. The levers are pivoted in such a way that the inside of plate 28 engages on the outside of lateral face 18 of clip 11. The lateral faces 18 of clip 11 are guided at the top and bottom in FIG. 5, i.e. on their front ends 19, 20, by rim 32 on the inside of leg 23. Slits 27 open to the now outwardly directed lateral faces of lever 22 and receive the pins 17. If the free ends of lever 22 formed by cross-member 24 are now pressed on one another, they spread clip 11 apart in such a way that the longitudinal edges 14 thereof are moved away from one another and a longitudinal slit is formed between them. The spread-apart clip can then be engaged on a stack of paper or the like. After releasing levers 22, clip 11 is clipped onto the paper stack as a result of its elasticity. Levers 22 can then be pivoted in the opposite rotation direction until they rest on the paper surface. They can then simply be removed, in that a slight force is exerted at right angles to the paper plane and therefore at right angles to the longitudinal edge 14 of clip 11. It is obviously also possible to only remove one of the levers 22 and to hang the paper stack with the other lever, whose plate 28 has a hole 33, on a nail or hook. Both levers can be removed if the paper stack is to be e.g. mailed as a cohesive block.

It is very simple to refit the lever, in order to detach the paper stack. The lever is brought into the vicinity of the clip in such a way that its slit 27 faces pin 17. In this position, as a result of the dimensions of the insides of legs 23, lever 22 can be guided on the clip, so that no problems are encountered in again fitting the lever to the clip.

Figure 6:
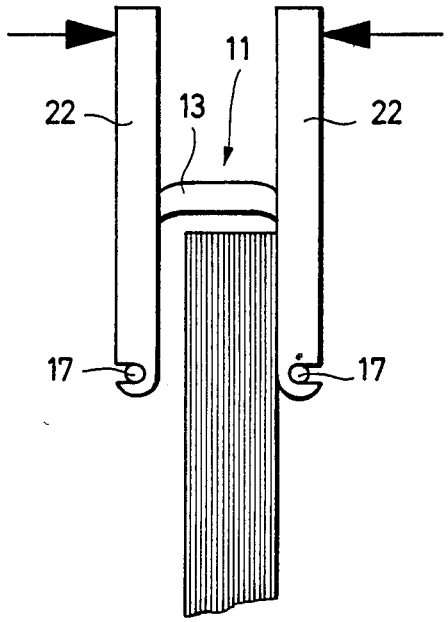
FIG. 6 is the opened clip.

FIG. 6 shows the clip in the opened state, into which it has been brought by force exerted in the direction of the arrows.

I claim:

1. A device for detachably clipping sheets and the like, comprising:

a clip constructed as a cross-sectionally roughly U-shaped profile, the profile having sides terminating in leg ends defining two longitudinal edges of the clip, the clip being resiliently biased to bring said longitudinal edges toward one another, the longitudinal edges having integrally molded pins extending in opposite directs from front ends of the longitudinal edges; and, two levers operable for spreading apart the longitudinal edges of the clip, the levers having lateral slits engagable on the pins by snapping the levers onto the pins in a push-button-like manner, and the levers being articulated to the clip at said pins at the front ends of the longitudinal edges, the levers being engaged against the sides of the clip to spread said longitudinal edges, the clip and the levers being molded plastic.

2. The device according to claim 1, wherein the levers are U-shaped and are oriented perpendicular to the U-shaped profile of the clip, the levers each having two legs running roughly parallel to the longitudinal edges of the clip, and a cross-member extending between the legs, and further comprising a plate interconnecting the legs.

3. The device according to claim 2, wherein an edge of the plate facing the longitudinal edge of the clip is spaced from the slits.

4. The device according to claim 2, wherein the legs of the lever are spaced by a distance equal to a length of the clip, whereby the legs are disposed alongside the clip.

5. The device according to claim 2, wherein the plate connects the legs of the lever and is thinner than the legs.

6. The device according to claim 2, wherein the plate connecting the legs is flush with an outside of the legs in a spread-apart position of the clip.

7. The device according to claim 1, further comprising gripping projections on at least one of two sides of the longitudinal edges of the clip that are directed towards one another.

8. The device according to claim 7, wherein the gripping projections are arranged in alternating manner on both said sides.

9. The device according to claim 1, wherein the longitudinal edges of the clip have thickened cross-section.

10. The device according to claim 9, wherein the longitudinal edges of the clip have a circular cylindrical cross-section.

11. The device according to claim 1, wherein the levers are U-shaped and are oriented perpendicular to the U-shaped profile of the clip, the levers each having two legs running roughly parallel to the longitudinal edges of the clip, and a cross-member extending between the legs.

* * * * *